US009932930B2

(12) United States Patent
Donahue

(10) Patent No.: US 9,932,930 B2
(45) Date of Patent: Apr. 3, 2018

(54) PISTON WITH REDUCED TOP LAND HEIGHT AND TIGHT TOP LAND PISTON PROFILE

(71) Applicant: General Electric Company, Schenectady, NY (US)

(72) Inventor: Richard John Donahue, West Bend, WI (US)

(73) Assignee: GENERAL ELECTRIC COMPANY, Schenectday, NY (US)

( * ) Notice: Subject to any disclaimer, the term of this patent is extended or adjusted under 35 U.S.C. 154(b) by 380 days.

(21) Appl. No.: 14/154,462

(22) Filed: Jan. 14, 2014

(65) Prior Publication Data

US 2015/0198113 A1 Jul. 16, 2015

(51) Int. Cl.

| | |
|---|---|
| ***F02B 3/00*** | (2006.01) |
| ***F02F 3/24*** | (2006.01) |
| ***F02F 3/28*** | (2006.01) |

(52) U.S. Cl.
CPC . *F02F 3/24* (2013.01); *F02F 3/28* (2013.01)

(58) Field of Classification Search
CPC ..... F02F 3/00
USPC ..... 123/193.6
See application file for complete search history.

(56) References Cited

U.S. PATENT DOCUMENTS

| | | | | |
|---|---|---|---|---|
| 3,476,021 A | | 11/1969 | Williams | |
| 4,106,463 A | | 8/1978 | Curtis, Jr. et al. | |
| 4,608,947 A | | 9/1986 | Stadler | |
| 4,829,955 A | | 5/1989 | Strasser | |
| 4,941,440 A | * | 7/1990 | Weber et al. | 123/193.6 |
| 4,989,559 A | * | 2/1991 | Fletcher-Jones | 123/193.6 |
| 5,052,281 A | | 10/1991 | Kawabata et al. | |
| 5,141,657 A | | 8/1992 | Fetterman et al. | |
| 5,323,744 A | * | 6/1994 | Kusama | F02F 3/00 123/193.6 |
| 5,435,872 A | * | 7/1995 | Penrice | B41F 16/00 123/193.6 |
| 6,112,715 A | * | 9/2000 | Nigro | F02F 3/00 123/193.6 |
| 6,347,575 B1 | | 2/2002 | Booker | |
| 7,677,217 B2 | | 3/2010 | Kumar et al. | |
| 8,459,175 B2 | | 6/2013 | Blythe et al. | |

FOREIGN PATENT DOCUMENTS

| | | |
|---|---|---|
| EP | 0485068 A1 | 5/1992 |
| EP | 653555 A1 | 5/1995 |
| EP | 952326 B1 | 6/2004 |
| EP | 800627 B1 | 1/2005 |
| EP | 2282084 A1 | 2/2011 |
| EP | 2096337 B1 | 8/2011 |

OTHER PUBLICATIONS

European Search Report and Opinion issued in connection with corresponding EP Application No. 15151029.4 dated May 29, 2015.

* cited by examiner

*Primary Examiner* — Marguerite McMahon
*Assistant Examiner* — James Kim
(74) *Attorney, Agent, or Firm* — Fletcher Yoder, P.C.

(57) ABSTRACT

An assembly includes a cylinder having a bore diameter, and a piston disposed within the cylinder. The piston is provided with a top land and a top ring groove. The top land and the cylinder are provided with a tight top land clearance. The ratio of the top land height to the bore diameter is less than or equal to 0.075.

9 Claims, 2 Drawing Sheets

PISTON WITH REDUCED TOP LAND HEIGHT AND TIGHT TOP LAND PISTON PROFILE

BACKGROUND OF THE INVENTION

The subject matter disclosed herein generally relates to pistons for internal combustion engines and more particularly to pistons with reduced top land height.

Internal combustion engines typically include a piston disposed inside a cylinder that may be provided with a cylinder liner. Piston rings that fit into a groove on the outer diameter of the piston are typically provided. The main task of the piston is to convert thermal energy into mechanical work. The piston may include a piston head, a top land, a pin support, and a skirt. Piston rings seal the combustion chamber from the crankcase and distribute and control the oil. The piston rings also stabilize the piston.

In the operation of internal combustion engines, it is common to see a decrease in power resulting from unburned fuel trapped within the top land height by the clearance formed between the top land and the cylinder liner (or the cylinder bore where there is no cylinder liner). The term crevice volume may be used herein for the purpose of describing this clearance volume where unburned fuel is trapped. This unburned fuel reduces engine efficiency and increases total hydrocarbon emissions.

One approach to reduce the top land crevice volume is the implementation of a reduced top land height. However, reduced top land heights increase top ring groove temperatures and cause ring groove deposits.

In the operation of internal combustion engines, it is common to see a decrease in power resulting from the accumulation of deposits in the combustion chambers. These deposits result from the burning of fuel and oil. The deposits are primarily composed of carbon.

The buildup of carbon deposits in the top land of a piston causes wear (polishing) of cylinder liners and carbon raking (vertical lines formed on the liner wall caused by carbon being raked down the liner). Such wear may result in the need to replace the cylinder liners. The wear may also result in increased maintenance and spare parts costs. Carbon buildup also affects performance of the internal combustion engine, including a reduction in output and efficiency and an increase in oil consumption.

One approach for dealing with carbon deposits is the implementation of a Tight Top Land (TTL) profile. In a TTL profile, the clearance between the top land and the cylinder liner is reduced. TTL profiles control the fundamental factors which drive deposits, namely temperature and residence time. Piston temperatures are reduced with a TTL profile because heat conduction out of the piston to the cylinder bore has been enabled and because the heat flux into the top land has been reduced. With reduced temperatures, deposits are less likely to form. Another reason for the cleanliness of the TTL profile is because the oil which is on the top land and in the top ring groove is being constantly replenished with a fresh supply of oil between the land and the liner due to the tight clearances. With this replenishment, the residence time of the oil on the top land and in the top ring groove is reduced, and with reduced residence time, deposits are also reduced.

BRIEF DESCRIPTION OF THE INVENTION

The disclosure provides a solution to the problem of the buildup of deposits on the top ring groove of a piston with reduced top land height.

In accordance with one exemplary non-limiting embodiment, the invention relates to an assembly for use in an internal combustion engine. The assembly includes a cylinder having a bore diameter and a piston disposed within the cylinder. The piston is provided with a top land having a top land height and a top ring groove. The top land and the cylinder is provided with a tight top land clearance and the ratio of the top land height to the bore diameter is less than or equal to 0.075.

In another embodiment, a piston for use with an internal combustion engine having a cylinder with a bore diameter is provided. The piston includes a top land having a top land height and a tight top land clearance with the cylinder, and wherein the ratio of the top land height to the bore diameter is less than or equal to 0.075.

In another embodiment, an internal combustion engine is provided. The internal combustion engine includes a cylinder having a bore diameter and a piston disposed in the cylinder, the piston having a top land with a top land height. The top land and the cylinder are provided with a tight top land clearance, and the ratio of the top land height to the bore diameter is less than or equal to 0.075.

BRIEF DESCRIPTION OF THE DRAWINGS

Other features and advantages of the present invention will be apparent from the following more detailed description of the preferred embodiment, taken in conjunction with the accompanying drawings which illustrate, by way of example, the principles of certain aspects of the invention.

DETAILED DESCRIPTION OF THE INVENTION

Figure 1:
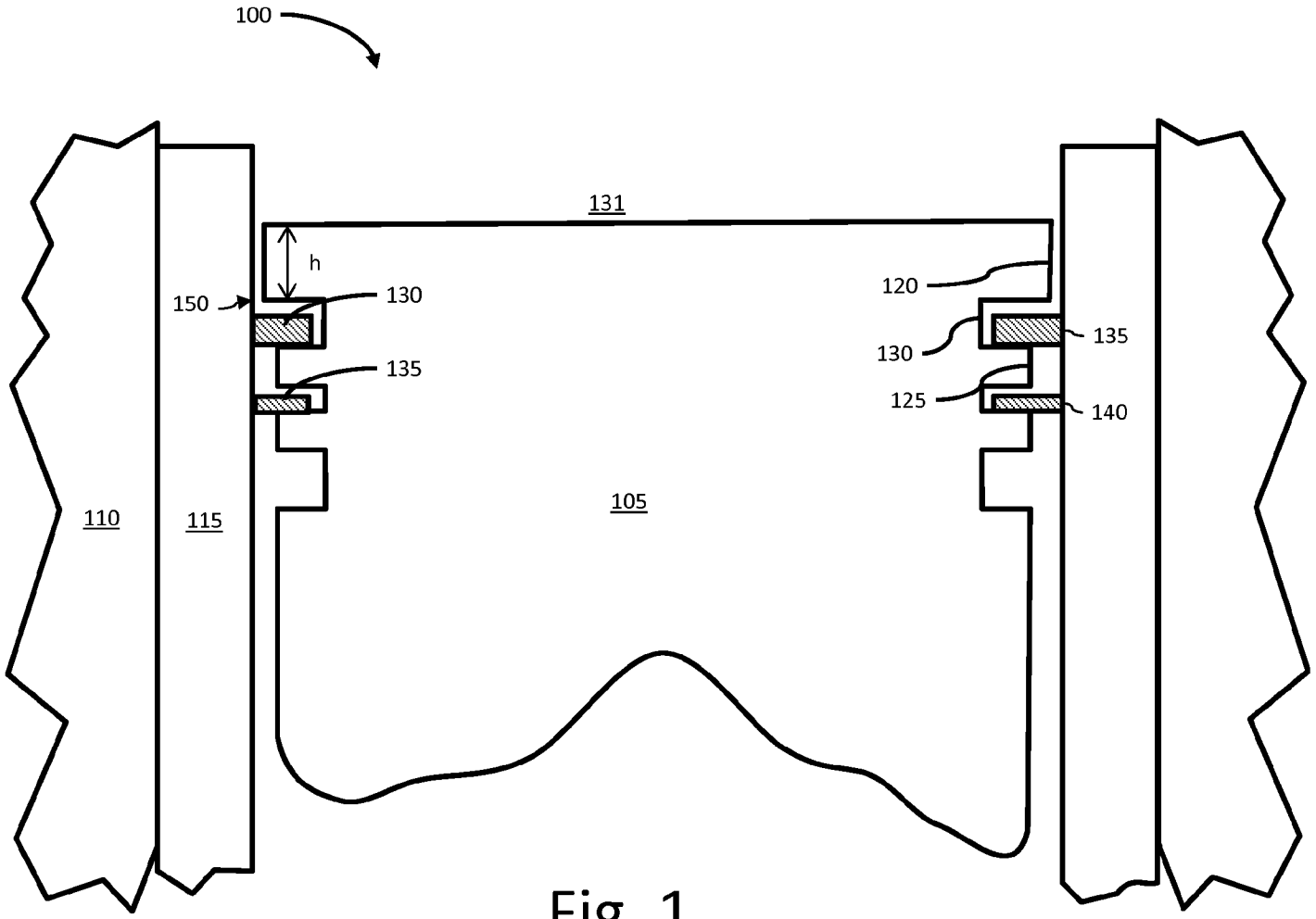
FIG. 1 is a cross-section schematic of a piston assembly in accordance with an embodiment.
Figure 2:
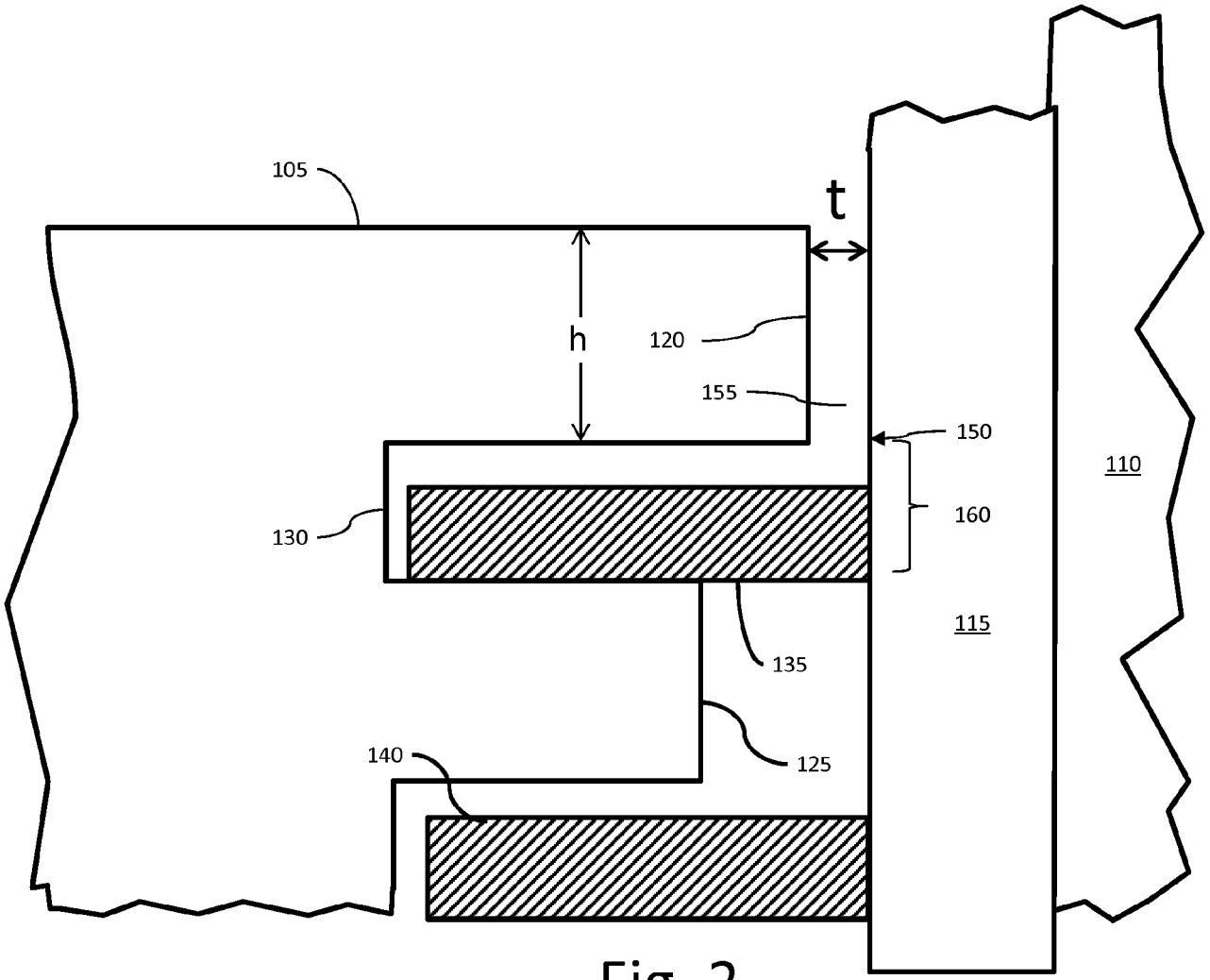
FIG. 2 is a fragmentary cross-sectional view of a piston assembly in accordance with an embodiment.

Illustrated in FIG. 1 is an embodiment of a piston assembly 100 for use in an internal combustion engine (not shown). The piston assembly 100 includes a piston 105, a cylinder bore 110 and may include a cylinder liner 115. The cylinder bore 110 and the cylinder liner 115 define an axis along which the piston 105 travels in a reciprocating fashion. The piston 105 includes a top land 120 and a second land 125 that define a top ring groove 130. A top ring 135 is disposed on the top ring groove 130. The top ring 135 helps to stabilize the piston 105 in the cylinder liner 115 and also prevents the passage of oil into the firing chamber 131. The piston 105 may also be provided with a second ring 140.

The piston 105 and cylinder liner 115 form a tight top land profile (TTL profile). In cases where there is no cylinder liner 115, the piston 105 and the cylinder bore 110 will form a TTL profile. For the purposes of this disclosure the term cylinder may refer to the cylinder bore 110 or the cylinder liner 115. A TTL profile is a configuration where the clearance between the top land 120 and the cylinder liner 115 (or the cylinder bore 110 where there is no cylinder liner 115) is reduced to reduce the amount of unburned hydrocarbon emissions generated in the firing chamber 131. A TTL piston profile is defined as having a top land diametral cold (i.e. room temperature) clearance of less than 0.46% of the nominal bore diameter for aluminum pistons in a lean burn engine. The TTL piston profile for an aluminum piston in a stoichiometric burn engine would have a diametral cold clearance of less than 0.53% of the nominal bore diameter.

For steel pistons, those clearances may be scaled based on the ratio of thermal expansion coefficients between steel and aluminum (between about 0.48 to 0.57). The resulting top land diametral cold clearance for steel pistons for a lean burn engine would be less than 0.29% of the nominal bore diameter and for a stoichiometric burn less than 0.33% of the nominal bore diameter. These cold clearances should be tight enough to provide a minimum clearance "t" preferably between 0 microns and 35 microns and more preferably between 5 microns and 25 microns radially when the engine operates at rated temperatures (herein "tight top land clearance" or "TTL clearance"). Clearances will vary during engine operation due to piston secondary motion and due to variation in bore distortions in the axial direction for the liner.

In one embodiment, the top land 120 has a reduced top land height h. Preferably, the ratio of the top land height h to the bore diameter of the cylinder bore 110 or cylinder liner 115 is less than or equal to 0.075. More preferably the ratio of the top land height h to the bore diameter of the cylinder bore 110 or cylinder liner 115 is less than or equal to 0.05 and even more preferably still less than or equal to 0.025. The TTL profile reduces the carbon deposits that ordinarily would be formed as a result of increased temperatures of the top ring 135 caused by the reduced top land height. Durable and reliable operation of the piston 105 is therefore provided with the combination of the top land 120 with a reduced top land height h and the TTL profile. The top land 120 with a reduced top land height h also reduces crevice volume. The implementation of the combination of the top land 120 with a reduced top land height h and the TTL profile provides for significant reduction in crevice volume. The technical and commercial advantage of this embodiment is that the top land crevice volume is reduced, thereby reducing total hydrocarbon emissions which improves engine fuel efficiency. Another commercial advantage is that engine durability and reliability is improved with essentially no change in initial cost of the power cylinder.

Where the definition of terms departs from the commonly used meaning of the term, applicant intends to utilize the definitions provided below, unless specifically indicated.

The terminology used herein is for the purpose of describing particular embodiments only and is not intended to be limiting of the invention. Where the definition of terms departs from the commonly used meaning of the term, applicant intends to utilize the definitions provided herein, unless specifically indicated. The singular forms "a", "an" and "the" are intended to include the plural forms as well, unless the context clearly indicates otherwise. It will be understood that, although the terms first, second, etc. may be used to describe various elements, these elements should not be limited by these terms. These terms are only used to distinguish one element from another. The term "and/or" includes any, and all, combinations of one or more of the associated listed items. The phrases "coupled to" and "coupled with" contemplates direct or indirect coupling.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements.

What is claimed:

1. An assembly for use in an internal combustion engine comprising:

a cylinder having a bore diameter;

a piston disposed within the cylinder, the piston having a top land with a top land height, wherein the top land of the piston is made of aluminum the top land and the cylinder having a tight top land clearance between an aluminum surface of the top land interfacing with an inner surface of the cylinder;

wherein the ratio of the top land height to the bore diameter is less than or equal to 0.025; and wherein the tight top land clearance is less than 25 microns at rated temperatures when the internal combustion engine operates at rated temperatures.

2. The assembly of claim 1, wherein the tight top land clearance is between 0 microns and 35 microns when the internal combustion engine operates at rated temperatures.

3. The assembly of claim 1, wherein the tight top land clearance is less than 0.46% of the bore diameter at room temperature for a lean burn engine and less than 0.53% of the bore diameter for a stoichiometric burn engine.

4. A piston for use with an internal combustion engine having a cylinder with a bore diameter, the piston comprising:

a top land made of metal and having a top land height and a tight top land clearance between a metal surface of the top land interfacing with an inner surface of the cylinder; and wherein the ratio of the top land height to the bore diameter is less than or equal to 0.025, and the tight top land clearance is less than 25 microns at rated temperatures when the internal combustion engine operates at rated temperatures.

5. The piston of claim 4, wherein the top land of the piston is made of aluminum and the tight top land clearance is less than 0.46% of the bore diameter at room temperature for a lean burn engine, and less than 0.53% of the bore diameter at room temperature for a stoichiometric burn engine.

6. The piston of claim 4, wherein top land of the piston is made of steel and the tight top land clearance is less than 0.29% of the bore diameter at room temperature for a lean burn engine, and less than 0.33% of the bore diameter at room temperature for a stoichiometric burn engine.

7. An internal combustion engine comprising:

a cylinder having a bore diameter;

a piston disposed in the cylinder, the piston having a top land with a top land height, wherein the top land of the piston is made of aluminum;

the top land and the cylinder having a tight top land clearance between an aluminum surface of the top land interfacing with an inner surface of the cylinder; and wherein the ratio of the top land height to the bore diameter is less than or equal to 0.075, and the tight top land clearance is less than 25 microns at rated temperatures when the internal combustion engine operates at rated temperatures.

8. The internal combustion engine of claim 7, wherein the tight top land clearance is less than 0.46% of the bore diameter at room temperature for a lean burn engine and the tight top land clearance is less than 0.53% of the bore diameter at room temperature for a stoichiometric burn engine.

9. The internal combustion engine of claim 7, wherein the ratio of the top land height to the bore diameter is less than or equal to 0.025.

* * * * *